US008209790B1

(12) United States Patent
Garry et al.

(10) Patent No.: US 8,209,790 B1
(45) Date of Patent: Jul. 3, 2012

(54) COMBINATION BATHROOM PLUNGING AND CLEANING TOOL

(75) Inventors: Steven Garry, Mesa, AZ (US); John Kinnard, Queen Creek, AZ (US)

(73) Assignee: Steven Garry, Mesa, AZ (US)

( * ) Notice: Subject to any disclaimer, the term of this patent is extended or adjusted under 35 U.S.C. 154(b) by 1234 days.

(21) Appl. No.: 11/869,134

(22) Filed: Oct. 9, 2007

Related U.S. Application Data

(63) Continuation-in-part of application No. 10/953,250, filed on Sep. 28, 2004, now Pat. No. 7,430,779, which is a continuation of application No. 10/729,693, filed on Dec. 5, 2003, now Pat. No. 7,299,519.

(60) Provisional application No. 60/850,751, filed on Oct. 11, 2006.

(51) Int. Cl.
*E03D 9/00* (2006.01)

(52) U.S. Cl. ..... 4/255.11

(58) Field of Classification Search ..... 4/225.11, 4/255.01, 255.05; 15/104.05, 105, 160, 104.33, 15/104.2, 104.16, 104.31, 104.001, 247, 15/184, 164, 248.1; 206/361
See application file for complete search history.

(56) References Cited

U.S. PATENT DOCUMENTS

| | | | | | |
|---|---|---|---|---|---|
| 1,018,939 | A | | 2/1912 | Sterrick | |
| D274,273 | S | | 6/1984 | Auerbach | |
| 4,972,541 | A | * | 11/1990 | Smith, Jr. | 15/105 |
| 5,423,621 | A | | 6/1995 | Russell | |
| D369,882 | S | * | 5/1996 | McCarthy | D28/7 |
| 5,617,605 | A | | 4/1997 | Hoerner | |
| 5,984,100 | A | * | 11/1999 | Ramsey et al. | 206/581 |
| 6,047,432 | A | * | 4/2000 | Sode | 15/160 |
| 6,073,274 | A | * | 6/2000 | McQueen | 4/245.4 |
| 6,202,242 | B1 | * | 3/2001 | Salmon et al. | 15/22.1 |
| 7,743,451 | B2 | * | 6/2010 | Kim | 15/145 |
| 2004/0036385 | A1 | * | 2/2004 | Connerton | 312/206 |
| 2004/0149608 | A1 | * | 8/2004 | Laux et al. | 206/349 |
| 2008/0052844 | A1 | * | 3/2008 | McKay | 15/22.1 |

* cited by examiner

*Primary Examiner* — Lori Baker
(74) *Attorney, Agent, or Firm* — Booth Udall, PLC

(57) ABSTRACT

A combination bathroom plunging and cleaning tool. Implementations may comprise a handle with a plurality of different detachable accessories. Accessories may include a plunger, a brush and a scrubber, for example. One or more of the accessories may comprise electronic components such as a vibrator or rotator to further accentuate the cleaning process. The handle and accessories may be stored in a storage caddy when not in use and the storage caddy may comprise air vents and a fan to dry the accessories after use.

20 Claims, 9 Drawing Sheets

COMBINATION BATHROOM PLUNGING AND CLEANING TOOL

CROSS REFERENCE TO RELATED APPLICATIONS

This application claims priority to U.S. Provisional Patent Application entitled "Combination Toilet Brush, Plunger & Accessories," now pending, Ser. No. 60/850,751, filed Oct. 11, 2006, and is a continuation-in-part of the earlier U.S. patent application to Steven P. Garry entitled "Combination Toilet Plunger and Brush," Ser. No. 10/953,250, filed Sep. 28, 2004, now pending, which application is a continuation-in-part of the earlier U.S. patent application to Steven P. Garry entitled "Combination Toilet Plunger and Brush," Ser. No. 10/729,693, filed Dec. 5, 2003, now pending, the disclosures of which is hereby incorporated herein by reference.

BACKGROUND OF THE INVENTION

1. Technical Field

This disclosure generally relates to tools for cleaning the toilet area and more specifically to a combination toilet plunger, brush and accessory tool in which the brush, plunger and accessories are configured to be selectively and removably coupled to the same handle.

2. State of the Art

Toilet plungers, toilet brushes, and mops or sponges have been used for many years. Their general structure, methods of manufacture, function and usefulness are well known. A conventional plunger is generally made of some form of resilient rubber material that includes a concave region. When a toilet plunger is pressed against a surface or into an opening, the space of the concave region is depressed and suction is created as the concave region is moved back to its original shape. Plungers are commonly used for forcing water into and suctioning matter out of drains and other plumbing fixtures. For convenience in manipulating the plunging end of the plunger, toilet plungers include a long, straight, rounded handle rod that the user grasps when moving the plunger up and down.

Conventional toilet brushes include a plurality of flexible bristles extending from a center rod or a bristle surface. The rod or surface is generally coupled to a handle for easy manipulation. The handle for a toilet brush is generally much shorter than the handle of a plunger (⅓ to ⅔ the length). Methods and materials for making and using toilet brushes, like plungers, are well known in the art.

Sponges and small mops for cleaning around the toilet area on the rim, exterior of the bowl, and floor surface have also been used for many years. Their general structure, methods of manufacture, function and usefulness are fairly well known. Typically, the sponge may also have a second surface with a more abrasive or scrubby type of material on one side to scrape away any additional hard-to-remove materials. Small mop heads that consist of multiple sponge like arms or tentacles may also be connected to one handle and are used to clean in and around the toilet bowl area.

Storage of toilet brushes, toilet plungers, and sponges are conventionally maintained somewhere in the bathroom and are generally very unsightly. Toilet brushes and plungers are generally stored separately, each having an elongated handle that requires tall or wide storage space. In recent years, short plastic cases or caddies have been used to enclose and store the bristle portion of the brush on the floor next to the toilet. The storage of these items in multiple areas such as under the cabinet or in various other locations around the home can be problematic when it comes to finding or using each cleaning device in a bathroom. Conventionally, plungers do not have a convenient storage caddy or hidden location for storage other than in a cupboard and even there the size and shape of the plunger makes storage difficult; particularly when the plunger is wet from cleaning a toilet.

Others have created combination brush and plunger tools that are not designed, intended or practical for many uses, including use with a toilet. In U.S. Design Pat. No. D274,273 to Auerbach (Jun. 12, 1984), Auerbach discloses a design for a garbage disposal thrust "plunger" and related brush. Different from a toilet plunger which creates suction to draw clogged materials from a drain, however, the plunger of Auerbach is a thrust stick to push items into a garbage disposal with short, rigid bristles on the end for scrubbing the disposal fixtures. The Auerbach tool could not be used to unclog a toilet by suction.

U.S. Pat. No. 5,617,605 to Hoerner et al. (Apr. 8, 1997) discloses a sink drain cleaning tool including a cleaning brush and thrust "plunger" handle at one end, a shield plate in the middle, and a brush handle at the other end. Use of this tool requires the user to grasp the brush end of the tool to thrust plunge and the plunger end to brush. It is likely that the user's hand will come in contact with contaminated tool surfaces during use.

SUMMARY

Aspects of this disclosure relate to a combination bathroom plunging and cleaning tool with detachable parts and a storage caddy.

Implementations of this disclosure relate to a combination bathroom plunging and cleaning tool comprising a plurality of selectably detachable accessories including two or more of a cleaning brush, a plunger, a sponge mop, and other attachment devices on the same end of a handle.

An implementation of a combination bathroom cleaning and plunging tool may comprise a handle with an accessory coupler at a first end responsive to an accessory release mechanism on the handle, a plurality of different bathroom accessories comprising at least a toilet plunger and a brush, but optionally also a sponge mop or other bathroom accessory, wherein each bathroom accessory comprises a first end configured to removably couple to the accessory coupler of the handle, and a storage caddy comprising an identifiable storage space configured for each accessory. In particular implementations, the brush may comprise a vibrator motor in the brush, and the vibrator motor may be coupled to a brush power coupling on a first end of the brush and the handle comprises a battery storage compartment and a handle power coupling on the accessory coupler operatively associated with the battery storage compartment and a switch configured to activate the handle power coupling. In particular implementations, the handle further comprises a battery storage compartment and a vibrator motor in the handle at or near the accessory coupler.

Particular implementations of a combination bathroom plunging and cleaning tool, the handle comprises a ring with an inside horizontal opening of at least 3 inches. In particular implementations of the handle, the release mechanism comprises a lever that has a first lever position in which the accessory coupler is configured to release the bathroom accessory and a second lever position in which the accessory coupler is configured to couple the bathroom accessory to the handle.

Particular implementations of the storage caddy further comprise a housing and a lid hingedly coupled to the housing. In more specific implementations, the storage caddy further comprises a fan within the housing and a plurality of air vents and the fan is arranged within the housing to generate air flow past the bathroom accessories and out of the air vents. The fan may be configured to generate the air flow for a predetermined period of time after at least one of the bathroom accessories is returned to the storage caddy. In particular implementations of the storage caddy, the storage caddy comprises identifiable storage space for each accessory and comprises a holding tray comprising a plurality of compartments, each associated with one of the bathroom accessories and each having a depth at least half of a height of the bathroom accessory associated with the compartment. One or more storage caddy compartments may be arranged to extend to its depth within the storage caddy at an angle to a horizontal plane. Particular compartments may comprise a liquid absorbent pad therein and that pad may comprise an antifungal and/or an antibacterial treatment.

Particular implementations of a method of operating a combination bathroom plunging and cleaning tool comprises removing a handle from a storage caddy housing at least a plunger accessory and a brush accessory; coupling the handle to the brush accessory by pressing a first end of the handle into a first end of the brush accessory; removing the brush accessory from and replacing the brush accessory to the storage caddy using the handle; detaching the handle from the brush accessory by actuating a release mechanism on the handle; and coupling the handle to the plunger accessory by pressing the first end of the handle into a first end of the plunger accessory.

Other particular implementations further comprise removing the plunger accessory from and replacing the plunger accessory to the storage caddy using the handle. Of course, while the brush or the plunger is removed from the storage caddy, it may be used to clean a bathroom or plunge a stopped-up toilet using the handle prior to replacing the bathroom accessory and handle to the storage caddy. In particular implementations, a fan within the storage caddy may be activated for a predetermined time after replacing the bathroom accessory to the storage caddy to dry the accessory.

The foregoing and other aspects, features, and advantages will be apparent to those artisans of ordinary skill in the art from the DESCRIPTION and DRAWINGS, and from the CLAIMS.

BRIEF DESCRIPTION OF THE DRAWINGS

Particular implementations of a combination bathroom plunging and cleaning tool will hereinafter be described in conjunction with the appended drawings, where like designations denote like elements, and.

DESCRIPTION

This disclosure, its aspects and implementations, are not limited to the specific components or assembly procedures disclosed herein, as virtually any components consistent with the intended operation of a method and/or system implementation for an electrical outlet cover may be utilized. Many additional components and assembly procedures known in the art consistent with the intended electrical outlet cover and/or assembly procedures for an electrical outlet cover will become apparent for use with particular implementations from this disclosure. Accordingly, for example, although particular implementations are disclosed, such implementations and implementing components may comprise any shape, size, style, type, model, version, measurement, concentration, material, quantity, and/or the like as is known in the art for such electrical outlet covers and implementing components, consistent with the intended operation.

Figure 1A:
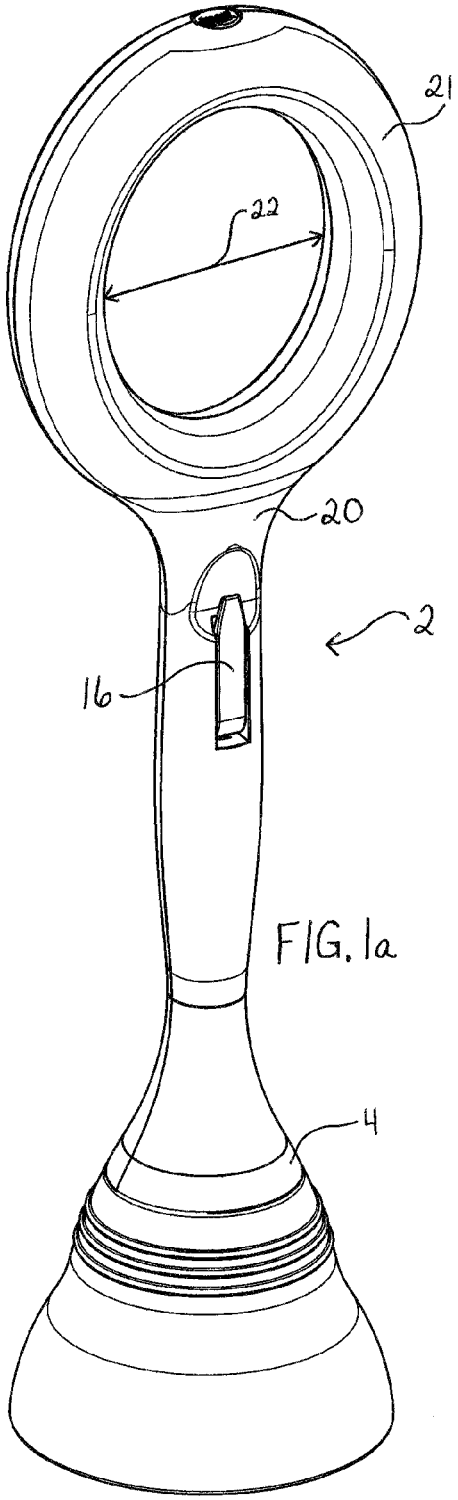
FIGS. 1*a* and 1*b* are perspective front and rear views of a combination bathroom plunging and cleaning tool with a plunger accessory attached.
Figure 1B:
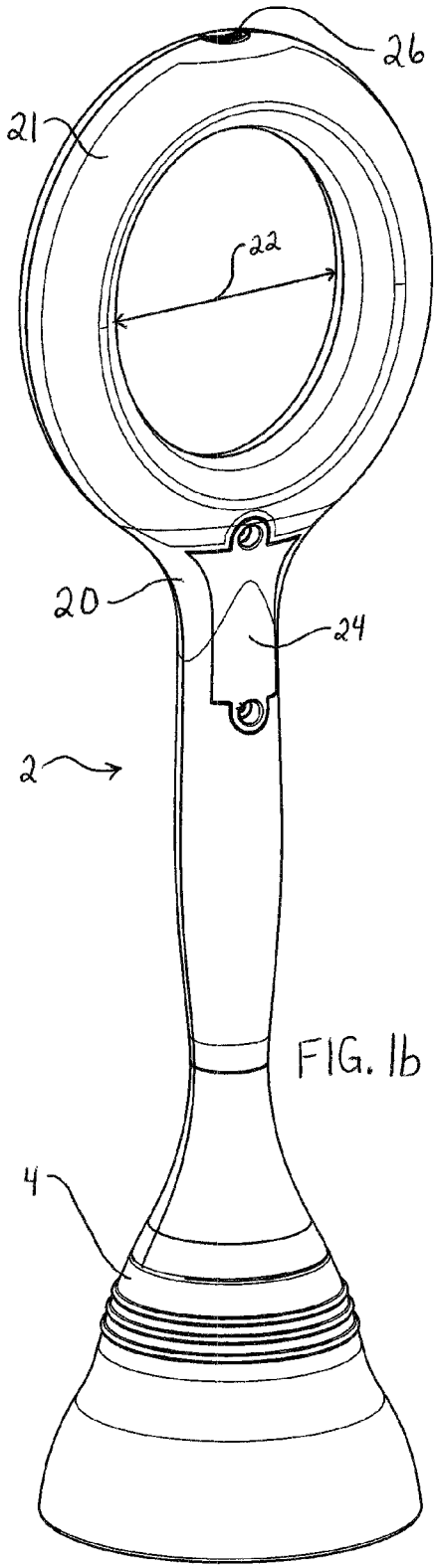
Figure 4A:
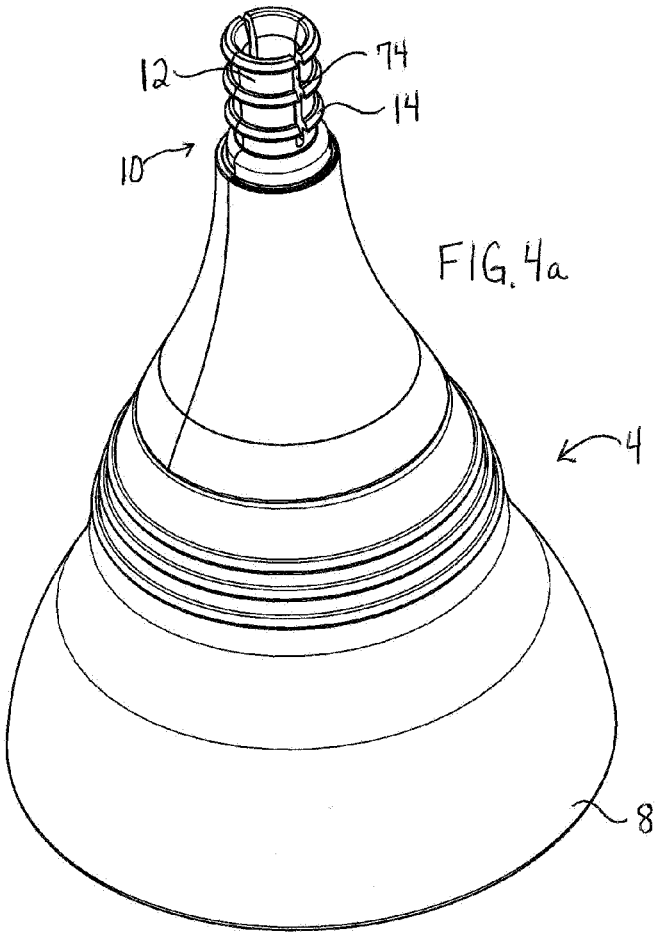
FIGS. 4*a* and 4*b* are views of a plunger accessory.
Figure 4B:
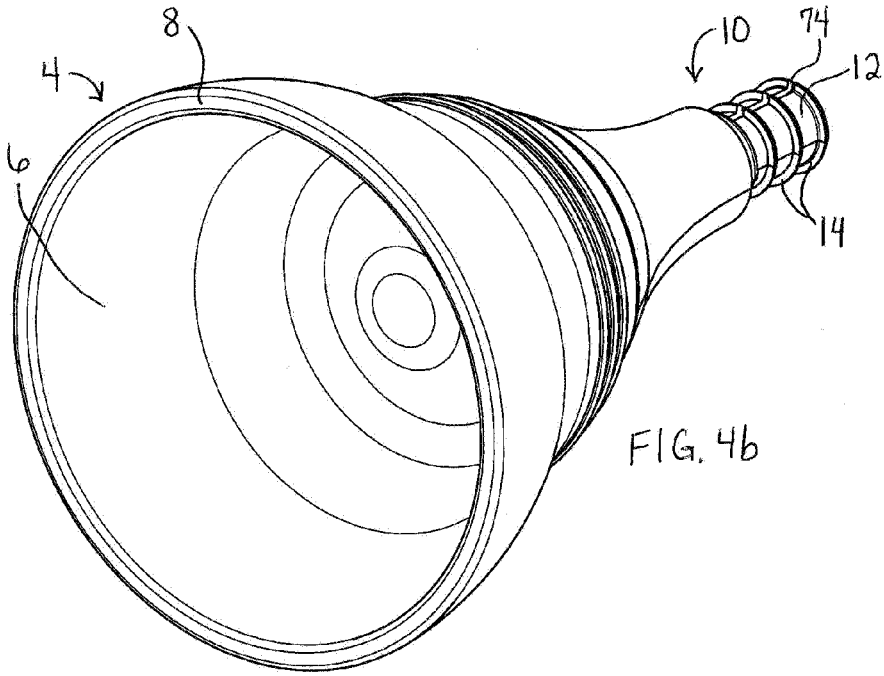

FIGS. 1*a* and 1*b* illustrate perspective views of a combination bathroom plunging and cleaning tool 2 with a plunging accessory 4 attached. FIGS. 4*a* and 4*b* illustrate one particular implementation of a plunging accessory 4. The plunging accessory 4 of the tool, like conventional plungers, may be made of a resilient material that generally retains its shape, but allows it to be significantly depressed and manipulated from its initial shape when a force is applied to create a suction on a pipe. Unlike "thrust plunging" which involves merely pushing debris, bathroom toilet and sink plunging involves moving the liquid surrounding the debris and creating a liquid thrust and pull as the plunger moves up and down and the concave plunger head changes shape. Through this movement, the plunging causes the liquid on the underside of the plunging accessory 4 to be pushed into the pipe when the plunging accessory 4 is pushed down, and sucks liquid out of the pipe when the plunging accessory 4 is released and allowed to reform to its original shape. This is distinct from a kitchen thrust plunger that merely pushes debris into a garbage disposal without creating suction around the area sufficient to cause the liquid to be forced within the pipe.

Specific examples of resilient materials include, but are not limited to, rubber and silicon. Other materials well known in the art of plunger manufacture are suitable for this purpose and may be substituted so long as the plunger has enough shape retention to function as a bathroom plunger. The precise shape of the plunging accessory 4 is not crucial, though the plunging accessory 4 should generally include a concave portion 6 with a substantially continuous surface 8 extending about its opening that can create suction when depressed against a surface or upon a drain.

As used herein, the term "concave" is intended to include not only generally curved, rounded or vaulted surfaces, but also other structures that include a hollow portion and an opening so that the structure, made of resilient material, can be collapsed or depressed to a size smaller than its shape-retaining size. Non-limiting examples of concave shapes include hemispheres, cones, boxes, pyramids, bells, shapes of known plungers, and all other shapes and combinations of linear and nonlinear shapes and structures that include an opening and a recess to allow for collapsing of the shape for plunging and suction. The concave shape of the plunging accessory 4 is generally a bell-shaped, bottle-shaped or cone-shaped structure with an opening facing away from the handle. The plunging accessory 4 may be molded or formed by methods known in the art for molding or forming the material used to make the plunging accessory 4. The particular line-shape for the curvature of the plunging accessory 4 and radius of curvature and point where the curvature occurs is not crucial.

As illustrated in FIGS. 4*a* and 4*b*, a first end 10 of the plunging accessory 4 comprises an accessory coupler 12 comprising a plurality of raised ridges 14. Operation of these raised ridges 14 are explained in more detail with reference to FIGS. 8 and 9. The accessory coupler 12 assists in coupling the plunging accessory 4 to the handle 20. A release mechanism 16 operates to couple or decouple the plunging accessory 4 to the handle 20.

Particular implementations of the handle may comprise an ergonomically designed handle 20 that may be formed of any material and using any method conventionally used for forming a cleaning tool handle. Examples of possible materials include, but are not limited to, plastic, wood, rubber, metal, and the like. Because plastic is easy to mold to a desired shape, cleans easily, is lightweight, and inexpensive, it is a particularly useful material for forming many cleaning product parts. However, parts of other materials may alternatively be used, such as a rubber comfort coating over a portion of a plastic handle, and the particular material used is not crucial.

In particular implementations, the handle 20 comprises a continuous ring 21 having an inner horizontal opening 22 of at least about 3 inches. Although the illustration in FIGS. 1*a* and 1*b* show the continuous ring 21 having a circular shape, other ring shapes, such as squares, rectangles, ovals, triangles, and other uniform and non-uniform shapes are all contemplated. The continuous nature of the shape provides additional stability and balanced plunging force, and the ring shape provides a convenient and comfortable gripping handle for the user with which to plunge.

The handle may also comprise a battery compartment 24 in which conventional or rechargeable batteries may be stored for use with bathroom accessories that require power. Although the particular implementation shown in FIG. 1*b* includes a battery access panel, it is contemplated that in particular implementations the batteries may be stored inside the handle without external access and then simply recharged when the handle 20 is coupled with the storage caddy. An activation switch 26 may be included on the handle 20 for activating the power for whatever electrical component is coupled to the accessory coupler.

Figure 2:
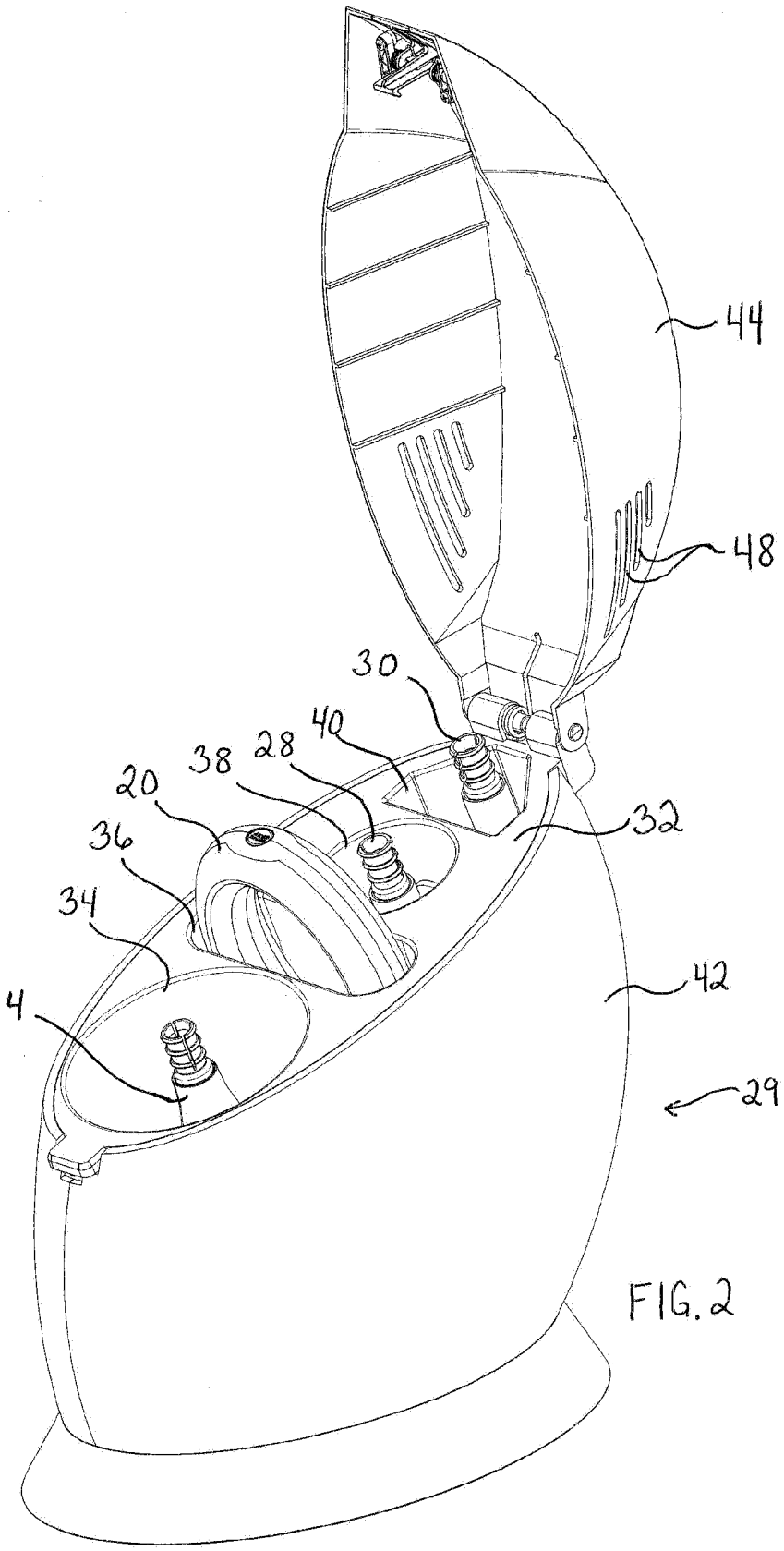
FIG. 2 is a perspective view of a combination bathroom plunging and cleaning tool stored in a caddy.
Figure 3:
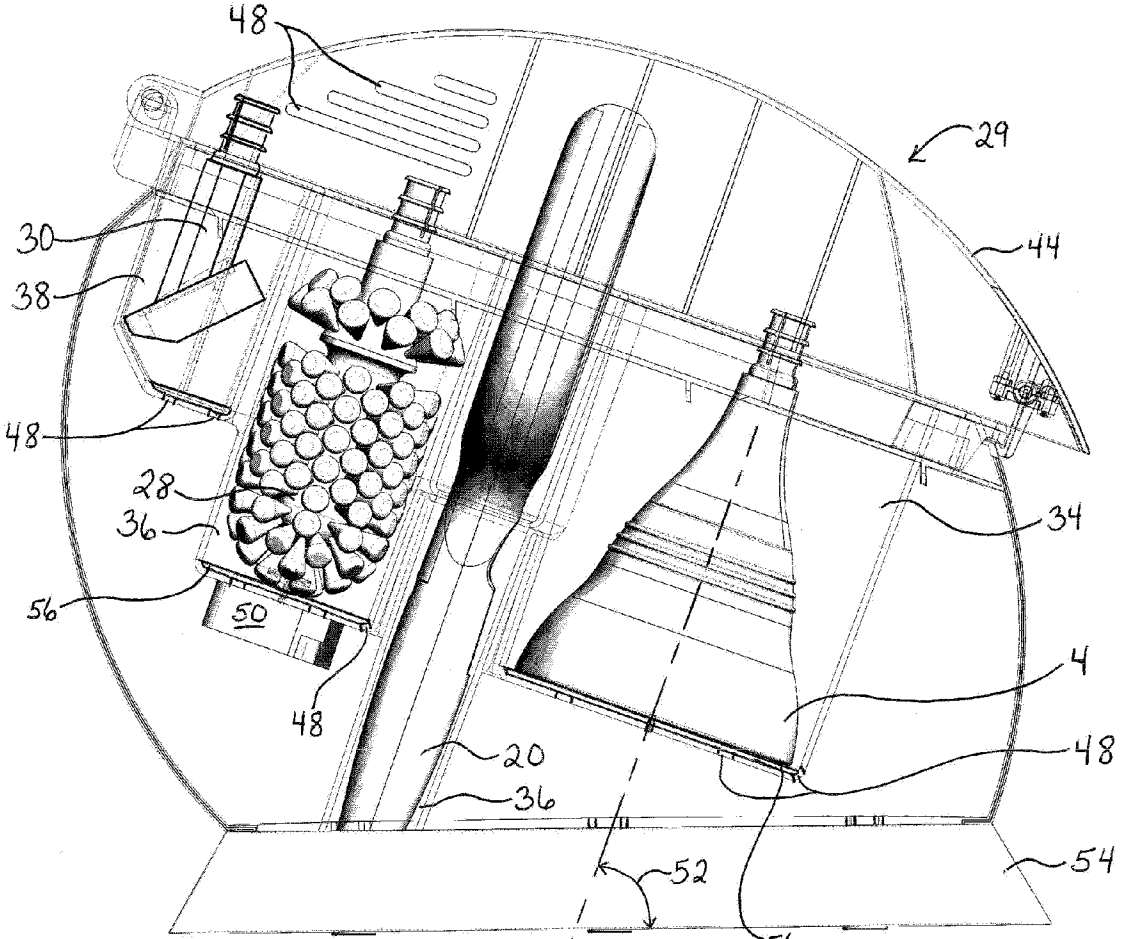
FIG. 3 is a see-through side view of the combination bathroom plunging and cleaning tool stored in the caddy of FIG. 2 with the caddy lines in ghost view to illustrate storage of the tool accessories.

FIG. 2 is a perspective view of a combination bathroom plunging and cleaning tool stored in a storage caddy 29 and FIG. 3 is a see-through side view of the same tool with the storage caddy 29 lines in ghost view to illustrate storage of a plurality of different bathroom plunging and cleaning tool accessories 4, 28 and 30. For this particular implementation, the tool comprises a handle 20, a plunging accessory 4, a brush accessory 28 and a sponge mop accessory 30. Each accessory 4, 28 and 30, sits in a tray 32 comprising an identifiable storage space 34, 36, 38 and 40 configured for each accessory 4, 28 and 30 and for the handle 20. The tray 32 is seated on a housing 42 hingedly coupled to a closeable lid 44. Air vents 46 and 48 are included in the lid 44 and in each of the storage spaces 34, 36, 38 and 40 for ventilation and excess water drainage.

Particular implementations of a storage caddy 29, a fan 50 may be coupled to a structure within the storage caddy housing 42, such as at the bottom of an accessory storage space 34, 36, 38 and 40, or to a wall of the housing 42 (with additional ventilation added). The fan 50 may be configured to generate air flow past the bathroom accessories 4, 20, 28 and 30 and through the air vents 48. Additional air vents may be included within the walls of housing 42 to increase fresh air flow with a less powerful fan motor. The fan 50 may be configured on a timer that maintains the fan on for a predetermined time (such as 30-360 seconds) after an accessory has been replaced. Alternatively, a moisture sensor may be included within the housing and the fan may be maintained on until the moisture sensor indicates that the moisture is sufficiently dissipated.

The storage tray 32 identifiable storage spaces 34, 36, 38 and 40 may comprise storage compartments having a depth at least half of the height of the bathroom accessory 4, 20, 28 and 30 associated with the compartment. The depth of the compartment may extend at an angle 52 to the base 54 of the housing 42. Angling the storage compartments of the identifiable storage spaces 34, 36, 38 and 40 improves excess water drainage and increases storage space within the housing 42 for the handle 20. One or more of the identifiable storage spaces 34, 36, 38 and 40 may comprise a replaceable or permanent absorbent pad 56 or liner to absorb excess liquid prior to it being evaporated through the air flow. The absorbent pad 56 may comprise an antifungal treatment to hinder fungal growth and/or an antibacterial treatment to reduce bacteria.

Additionally, although not shown in the particular implementation of FIGS. 2 and 3, a combination bathroom cleaning tool 2 may incorporate additional features such as additional accessory attachments, extension bars and/or larger scrubbing pads along with different types of abrasive and nonabrasive materials to be used with the accessories illustrated and described with reference to FIGS. 2 and 3. Toilet ring scouring attachments and other types of mop head attachments may also be used.

Other adjustments that may make the tool 2 smaller and more compact may also be included, such as, by non-limiting example, a telescoping, collapsing, folding handle or a method by which the handle length may be reduced, altered or adjusted. Additionally, the handle, brush, plunger, and sponge-mop heads may also be compacted, folded or incorporated onto themselves or into a device or unit. Thus, the tool may have an attractive and compact appearance making it possible to store in an area that is functionally convenient. Such appearance may be, but is not limited to a wand, a cane, a retracted umbrella, a baseball bat, or other such shape that may aid in the design and/or marketing of the tool.

Figure 5:
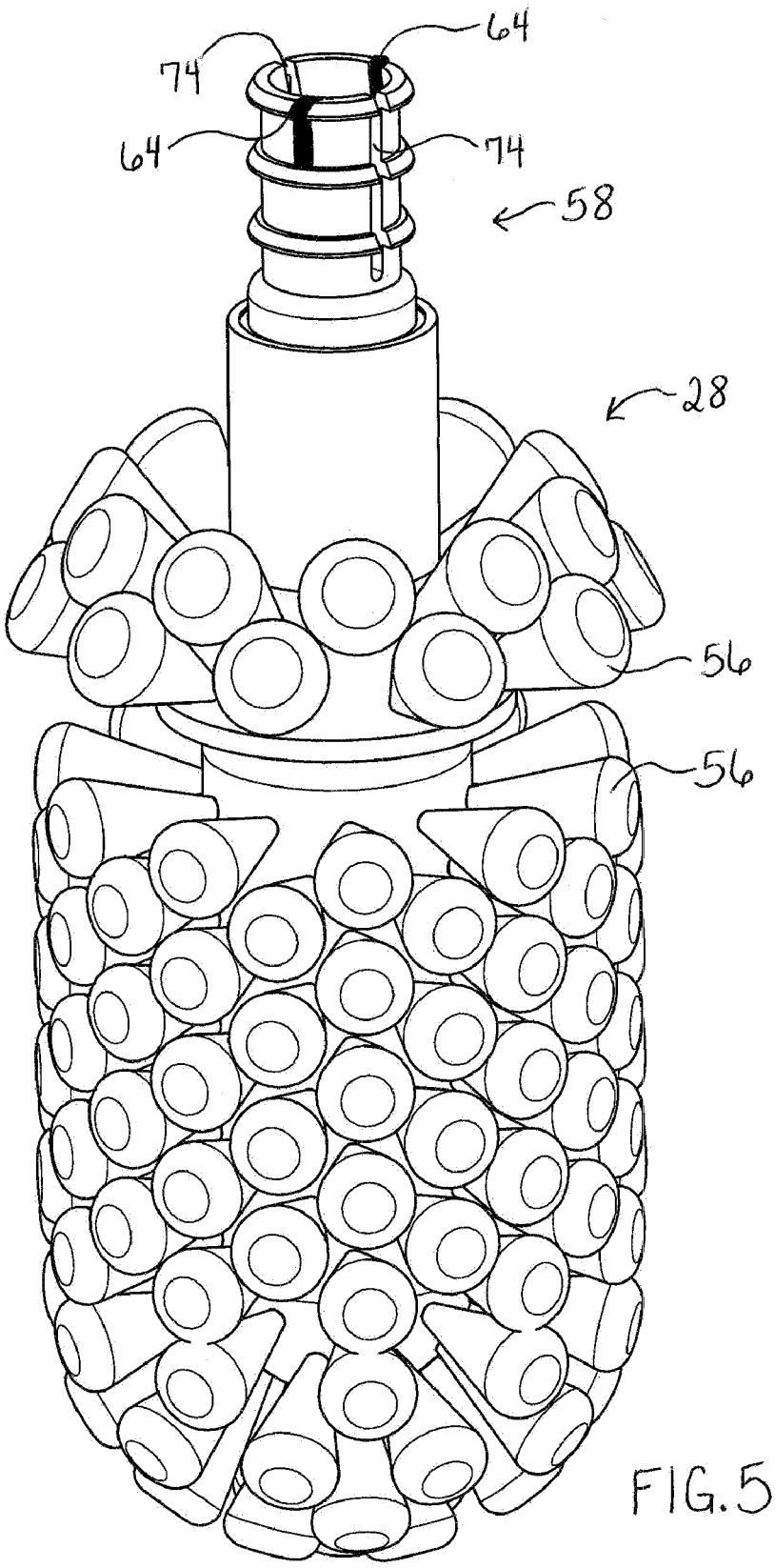
FIG. 5 is a view of a brush accessory.
Figure 6A:
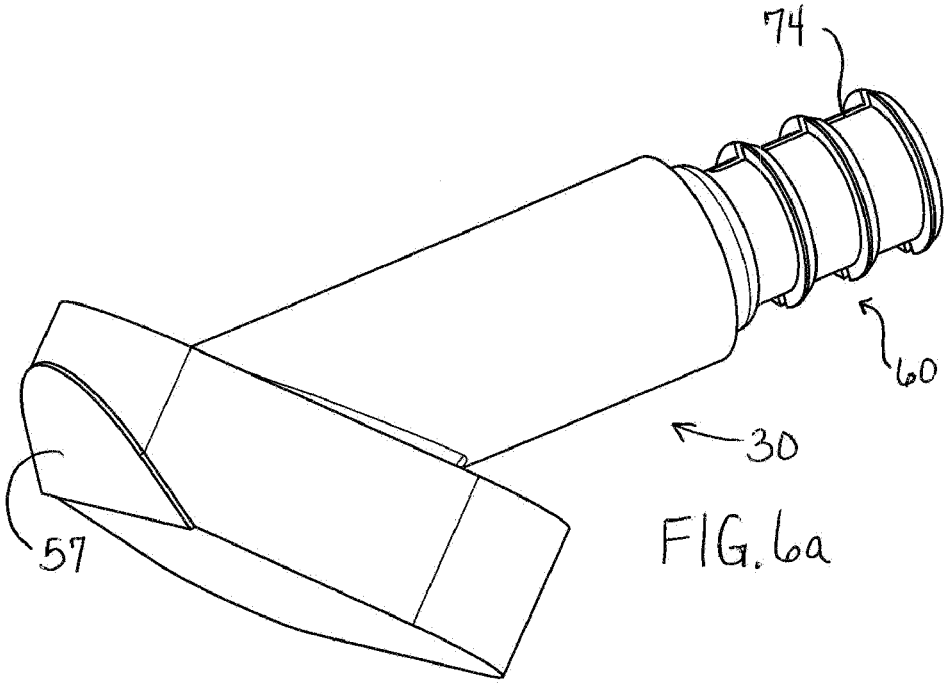
FIG. 6 is a view of a scrubber accessory.
Figure 6B:
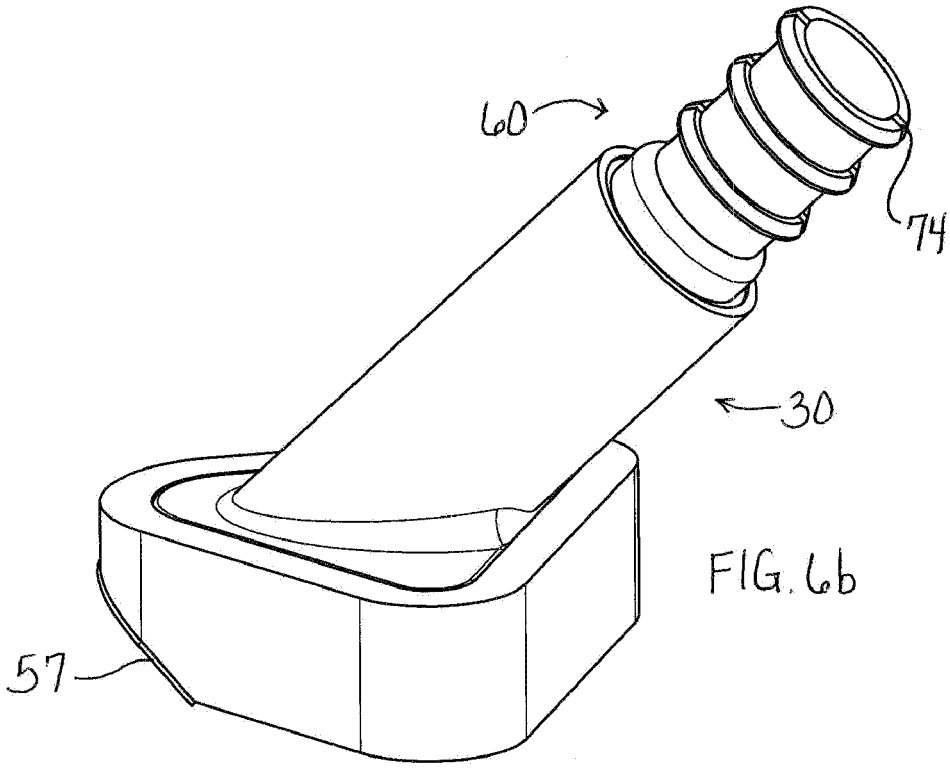

FIG. 5 is a view of the brush accessory 28 and FIGS. 6*a* and 6*b* are views of the sponge mop 30 introduced with reference to FIGS. 2 and 3. The materials through which the brush 28, brush bristles 56, and sponge-mop 30 may be made include all conventional and non-conventional brush-making and sponge making materials such as polyester, foam, nylon, micro fiber, soft plastic, rubber, and the like. It is contemplated that in particular implementations a material that dries rapidly will be of best use for both the brush and the sponge-mop. It is desirable to have a material that inhibits bacterial growth so new innovative materials such as micro fibers and other that may be treated with anti-bacterial substances may be of use depending upon the particular application in which the tool will be used. However, in most instances the sponge-mop 30 and brush 28 materials will be formed from a resilient, durable material sufficient for wiping and scrubbing relatively smooth surfaces such as porcelain, plaster, polished metal, stone, and other surfaces typically found around plumbing drains. Specifically, the sponge mop 30 may comprise an abrasive pad 57.

Figure 7:
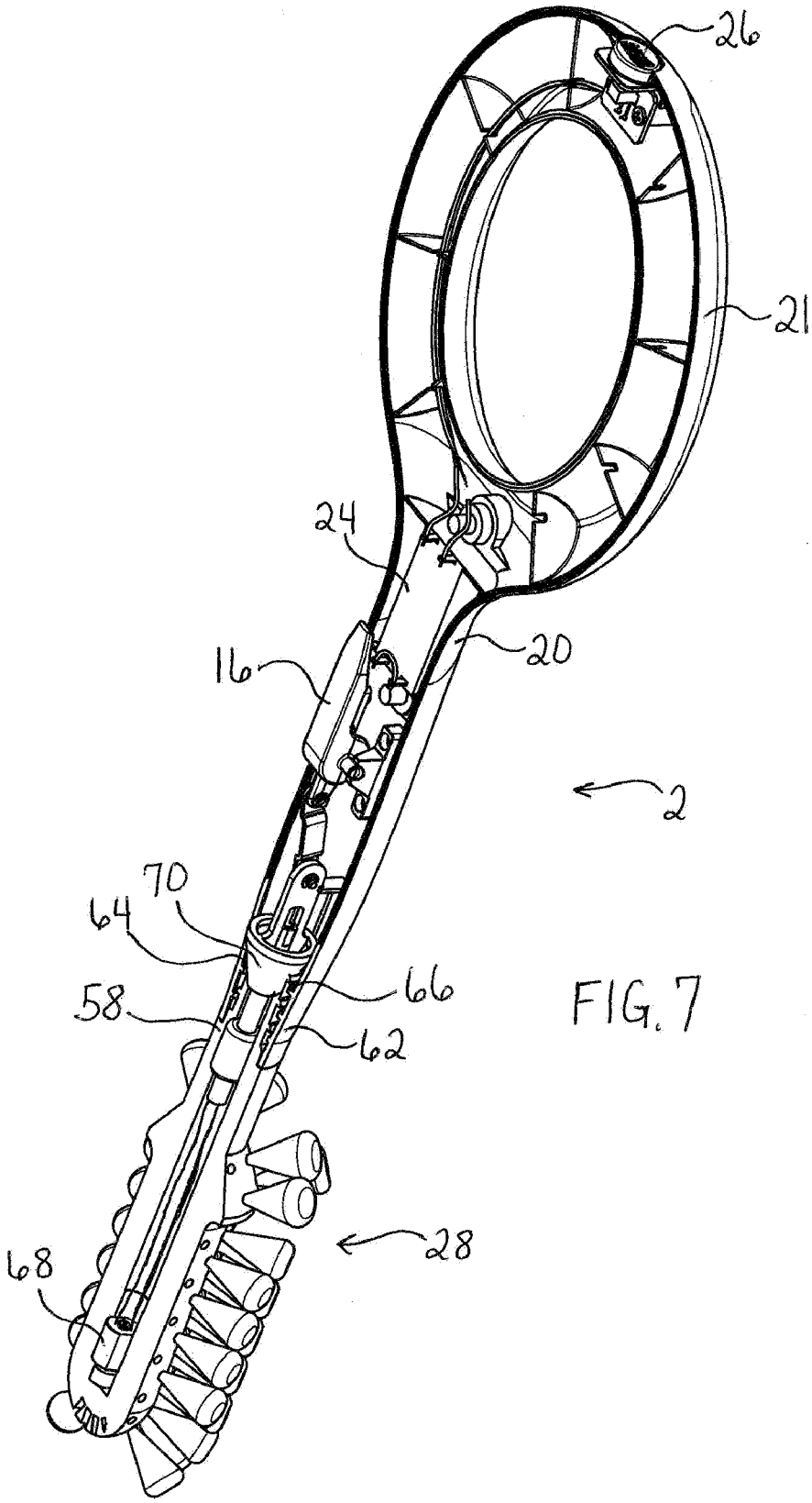
FIG. 7 is a horizontal cross-section view of a combination bathroom plunging and cleaning tool with a brush accessory attached.

Each of the brush 28 and sponge mop 30 comprises a brush coupling 58 and sponge mop coupling 60 configured to couple with an accessory coupling 62 on the handle 20 (FIG. 7). The brush coupling 58 and the sponge mop coupling 60 assists in removably coupling and decoupling the brush 28 and sponge mop 30 from the handle 20.

FIG. 7 is a horizontal cross-section view of a combination bathroom plunging and cleaning tool 2 with a brush accessory 28 attached and the lever 16 and engaging piston 70 shown not in cross-section. The switch 26 is operatively coupled to the battery storage 24 for the tool 2. In the particular implementation of FIG. 7, the brush 28 comprises a vibrating motor 68 within the brush 28 and electrically coupled to a brush power coupling 64 on the brush coupling 58. The brush power coupling 64, couples to the handle power coupling 66 which is electrically and operably coupled with the battery storage 24 and switch 26 such that activation of the switch 26 will activate the vibrating motor 68 within the brush. By non-limiting example, the vibrating motor may be part number FF-N20PA made by Mabuchi Motor, Co. Ltd. Of Chiba, Japan. A slight oscillation or vibration caused by a vibrator within the brush accessory 28 may assist in bathroom scrubbing. Alternatively, the vibrator 68 may be included within the handle 20 at or near the accessory coupling 62 so that the vibrator 68 may be used for all accessories.

An engaging piston 70, in response to actuation of the release mechanism 16, extends into or withdraws from the end of the accessory at the accessory coupling 62. As illustrated more clearly in FIGS. 8 and 9, the raised ridges 14 of each accessory coupling (brush coupling 58 in FIGS. 8 and 9) engage the raised ridges 72 of the accessory coupling 62 of the handle 20 when the engaging piston 70 is extended into the accessory coupling (brush coupling 58 in FIGS. 8 and 9) and push out the sides of the accessory coupling. Slits 74 (FIGS. 4, 5 and 6) along the sides of the accessory couplings for each accessory allow the accessory couplings for each accessory to expand outward for engagement.

Figure 8:
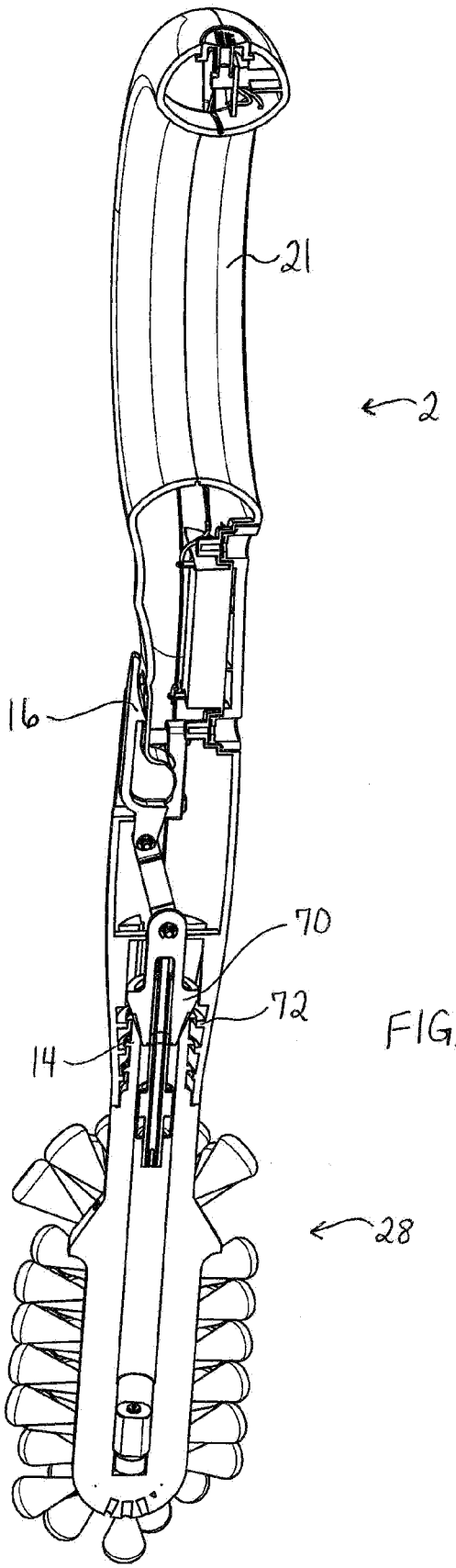
FIG. 8 is a vertical cross section view of the combination bathroom plunging and cleaning tool of FIG. 7 with the release handle closed.
Figure 9:
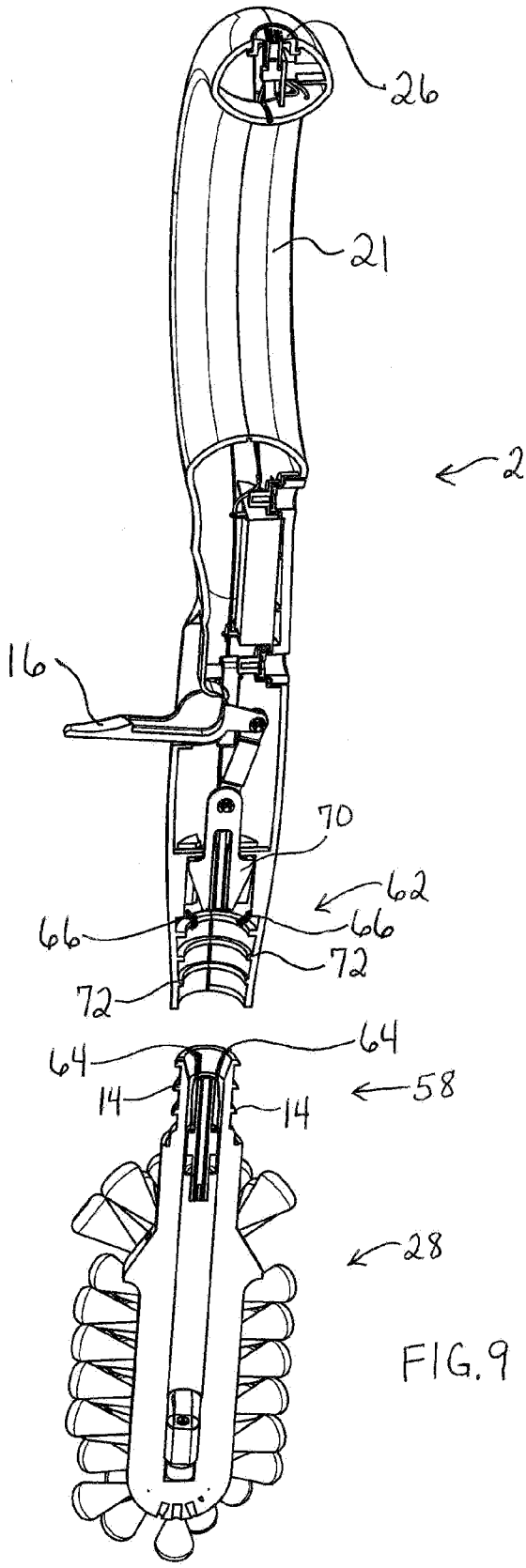
FIG. 9 is a vertical cross section view of the combination bathroom plunging and cleaning tool of FIG. 7 with the release handle opened.

In specific reference to FIGS. 8 and 9, when the release mechanism 16 is in its release position (FIG. 9), the engaging piston 70 is retracted and releases the bathroom accessory (brush 28 in FIG. 9). To couple the handle to the brush accessory 28 in FIG. 9, the handle 20 accessory coupling 62 is placed over the brush accessory coupling 58 and the release mechanism 16 is moved to its closed position (FIG. 8) which pushes the engaging piston 70 into the brush accessory coupling 58, opens the slits 74 (FIG. 5) wider, and engages the extending ridges 14 on the brush accessory coupling 58 with the extending ridges 72 of the brush accessory coupling 58.

Part of the accessory couplings and handle components comprise waterproof seals on the handle openings (primarily seams, buttons, and lever areas) and at the coupling or interlocking point between the accessories and the handle. There is a simple seal such as an o-ring or other type of waterproof seal that becomes of use when the accessories are coupled to the end of the handle. Specifically for the accessory couplings, in addition to the seal that may be created between the extending ridges 14 and 72 at the accessory couplings, additional seals may be used between the handle and accessory couplings. Specifically with reference to the engaging piston 70, the components may be made of metal, hard plastic or other types of durable materials that would allow such a task to be performed. The various other components shown in the various drawings may drawings assist in operating the combination bathroom plunging and cleaning tools.

In use, with reference to FIG. 2, a user in need of any of the accessories available from the combination plunging and cleaning tool may simply open the housing lid 44, remove the handle 20, open the release mechanism 16 (FIG. 9) and couple the handle to an accessory by pressing the handle accessory coupling 62 against the accessory coupling of a selected accessory 4, 28 or 30. The release mechanism 16 may then be moved to its closed position to couple the handle to an accessory. The accessory is removed from the housing 29 with the handle and may be used for its intended function to plunge a stopped-up toilet or drain or brush or mop around a toilet or other bathroom fixture. When the user is done using the accessory and has rinsed it off, the user can replace the accessory in the storage space 34, 38 or 40 sized and/or shaped for that accessory 4, 28 or 30 in the storage caddy 29. When the accessory is in place, the user may then release the accessory from the handle by releasing the release mechanism 16. Either the user can select another accessory to use or replace the handle 20 into its storage space 36. When the user replaces the handle 20, or when the user closes the lid 44 depending upon the particular configuration, the fan 50 (FIG. 3) automatically turns on (through a sensor in the storage caddy 29) and remains on for a predetermined time period. That time period may be based upon a time limit or upon a second sensor within the storage caddy 29 that senses moisture content within the storage caddy 29 and turns the fan off when it reaches a predetermined moisture level.

Particular implementations of a combination bathroom plunging and cleaning tool allow the handle and its accessories to be used in water filled areas such as toilets but they can also be used in other areas such as, but not limited to, floors, showers, tubs etc. The vibrating brush may also be conveniently stored in the container and the plunger may be attached. When plunging is done and the user wants to use the sponge-mop, it may be attached and detached by way of the lever disconnect. The ability to have a single tool for multiple cleaning activities and use a smaller storage space then if all these tools had their own handle, is a great advantage. By enclosing the accessories in a decorative housing the often offensive-looking toilet plunger, toilet brush, and cleaning sponge or mop can be attractively and functionally hidden.

Implementations of a combination bathroom plunging and cleaning tool and implementing components (bristles, heads, couplers, levers, lids, caddies, compartments, trays, fans, etc.) may be constructed of a wide variety of materials. For example, the components may be formed of: rubbers (synthetic and/or natural) and/or other like materials; glasses (such as fiberglass), carbon-fiber, aramid-fiber, any combination thereof, and/or other like materials; polymers such as thermoplastics (such as ABS, Fluoropolymers, Polyacetal, Polyamide; Polycarbonate, Polyethylene, Polysulfone, and/or the like), thermosets (such as Epoxy, Phenolic Resin, Polyimide, Polyurethane, Silicone, and/or the like), any combination thereof, and/or other like materials; for particular parts composites and/or other like materials; metals, such as zinc, magnesium, titanium, copper, lead, iron, steel, carbon steel, alloy steel, tool steel, stainless steel, brass, tin, antimony, aluminum, any combination thereof, and/or other like materials; alloys, such as aluminum alloy, titanium alloy, magnesium alloy, copper alloy, any combination thereof, and/or other like materials; any other suitable material; and/or any combination of the foregoing thereof.

Some components defining any implementation may be manufactured simultaneously and integrally joined with one another, while other components may be purchased pre-manufactured or manufactured separately and then assembled with the integral components. The various implementations may be manufactured using conventional procedures as added to and improved upon through the procedures described here.

Accordingly, manufacture of these components separately or simultaneously may involve vacuum forming, injection molding, blow molding, casting, forging, cold rolling, milling, drilling, reaming, turning, grinding, stamping, pressing, cutting, bending, welding, soldering, hardening, riveting, punching, plating, and/or the like. Components manufactured separately may then be coupled or removably coupled with the other integral components in any manner, such as with adhesive, a weld joint, a solder joint, a fastener (e.g. a bolt and a nut, a screw, a rivet, a pin, and/or the like), washers, retainers, wrapping, wiring, any combination thereof, and/or the like for example, depending on, among other considerations, the particular material forming the components.

In places where the description above refers to particular implementations of a combination bathroom plunging and cleaning tool, it should be readily apparent that a number of modifications may be made without departing from the spirit thereof and that these implementations may be applied to other bathroom plunging and cleaning tools.

The accompanying claims are intended to cover such modifications as would fall within the true spirit and scope of the disclosure set forth in this document. The presently disclosed implementations are, therefore, to be considered in all respects as illustrative and not restrictive, the scope of the disclosure being indicated by the appended claims rather than the foregoing description. All changes that come within the meaning of and range of equivalency of the claims are intended to be embraced therein.

The invention claimed is:

1. A combination bathroom cleaning and plunging tool comprising:

a handle comprising an accessory coupler at a first end responsive to an accessory release mechanism on the handle, the release mechanism comprising a lever;

a plurality of different bathroom accessories comprising at least a toilet plunger and a brush, wherein each bathroom accessory comprises a first end configured to removably couple to the accessory coupler of the handle; and a storage caddy comprising an identifiable storage space configured for each accessory;

wherein in a first lever position the accessory coupler is configured to release the bathroom accessory and in a second lever position the accessory coupler is configured to couple the bathroom accessory to the handle.

2. The combination bathroom cleaning and plunging tool of claim 1, the brush further comprising a vibrator motor within the brush.

3. The combination bathroom cleaning and plunging tool of claim 2, wherein the brush further comprises a brush power coupling extending from the vibrator motor to the first end of the brush and the handle further comprises a battery storage compartment, a handle power coupling on the accessory coupler operatively associated with the battery storage compartment and a switch configured to activate the handle power coupling.

4. The combination bathroom cleaning and plunging tool of claim 1, wherein the handle further comprises a battery storage compartment and a vibrator motor at or near the accessory coupler.

5. The combination bathroom cleaning and plunging tool of claim 1, the handle further comprising a ring comprising an inside horizontal opening of at least about 3 inches.

6. The combination bathroom cleaning and plunging tool of claim 1, wherein the plurality of bathroom accessories further comprises at least one sponge mop.

7. The combination bathroom cleaning and plunging tool of claim 1, the storage caddy further comprising a housing and a lid hingedly coupled to the housing.

8. The combination bathroom cleaning and plunging tool of claim 7, wherein the storage caddy further comprises a fan within the housing and a plurality of air vents, the fan arranged within the housing to generate air flow past the bathroom accessories and out of the air vents.

9. The combination bathroom cleaning and plunging tool of claim 8, wherein the fan is configured to generate air flow for a predetermined period of time after at least one of the bathroom accessory is returned to the storage caddy.

10. The combination bathroom cleaning and plunging tool of claim 8, wherein the storage caddy identifiable storage space for each accessory comprises a holding tray comprising a plurality of compartments, each associated with one of the bathroom accessories and each having a depth at least half of a height of the bathroom accessory associated with the compartment.

11. The combination bathroom cleaning and plunging tool of claim 10, wherein the plurality of compartments are each arranged to extend to its depth within the storage caddy at an angle to a horizontal plane.

12. The combination bathroom cleaning and plunging tool of claim 10, wherein at least one of the compartments comprises an absorbent pad therein.

13. The combination bathroom cleaning and plunging tool of claim 12, wherein the absorbent pad comprises at least one of an antifungal and an antibacterial treatment thereon.

14. A method of operating a combination bathroom plunging and cleaning tool, the method comprising:

removing a handle from a storage caddy housing at least a plunger accessory and a brush accessory;

coupling the handle to the brush accessory by pressing a first end of the handle into a first end of the brush accessory;

removing the brush accessory from and replacing the brush accessory to the storage caddy using the handle;

detaching the handle from the brush accessory by actuating a release mechanism on the handle;

coupling the handle to the plunger accessory by pressing the first end of the handle into a first end of the plunger accessory;

removing the plunger accessory from and replacing the plunger accessory to the storage caddy using the handle; and activating a fan within the storage caddy for a predetermined time period after replacing the brush assembly to the storage caddy.

15. The method of claim 14, further comprising brushing an inside surface of a toilet with the brush prior to replacing the brush accessory to the storage caddy using the handle.

16. The method of claim 14, further comprising plunging a stopped-up toilet with the plunger accessory prior to replacing the plunger accessory to the storage caddy using the handle.

17. A combination bathroom cleaning and plunging tool comprising:

a handle comprising an accessory coupler at a first end responsive to an accessory release mechanism on the handle;

a plurality of different bathroom accessories comprising at least a toilet plunger and a brush, wherein each bathroom accessory comprises a first end configured to removably couple to the accessory coupler of the handle; and a storage caddy comprising an identifiable storage space configured for each accessory;

wherein the brush comprises a vibrator motor within the brush and a brush power coupling extending from the vibrator motor to the first end of the brush; and wherein the handle comprises a battery storage compartment, a handle power coupling on the accessory coupler operatively associated with the battery storage compartment and a switch configured to activate the handle power coupling.

18. The combination bathroom cleaning and plunging tool of claim 17, the handle further comprising a ring comprising an inside horizontal opening of at least about 3 inches.

19. The combination bathroom cleaning and plunging tool of claim 17, wherein the storage caddy further comprises a fan within the housing and a plurality of air vents, the fan arranged within the housing to generate air flow past the bathroom accessories and out of the air vents.

20. The combination bathroom cleaning and plunging tool of claim 19, wherein the fan is configured to generate air flow for a predetermined period of time after at least one of the bathroom accessory is returned to the storage caddy.

* * * * *